US007955103B2

(12) United States Patent
Konno et al.

(10) Patent No.: US 7,955,103 B2
(45) Date of Patent: Jun. 7, 2011

(54) CONNECTOR

(75) Inventors: Takeshi Konno, Tokyo (JP); Katsuhiro Hori, Tokyo (JP); Makoto Watanabe, Tokyo (JP); Masanori Suzuki, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 180 days.

(21) Appl. No.: 12/458,033

(22) Filed: Jun. 29, 2009

(65) Prior Publication Data

US 2010/0009552 A1 Jan. 14, 2010

(30) Foreign Application Priority Data

Jun. 30, 2008 (JP) ..... 2008-171544

(51) Int. Cl.
*H01R 29/00* (2006.01)

(52) U.S. Cl. ..... 439/188; 439/630

(58) Field of Classification Search ..... 439/188, 439/62, 630–632
See application file for complete search history.

(56) References Cited

U.S. PATENT DOCUMENTS

| | | | | |
|---|---|---|---|---|
| 7,070,429 | B2 * | 7/2006 | Kodera et al. | 439/159 |
| 7,074,089 | B2 * | 7/2006 | Kajiura et al. | 439/620.01 |
| 2006/0116027 | A1 | 6/2006 | Tseng et al. | |

FOREIGN PATENT DOCUMENTS

| | | | |
|---|---|---|---|
| JP | 2003-22870 | A | 1/2003 |
| JP | 2004-127693 | A | 4/2004 |
| JP | 2005-71666 | A | 3/2005 |
| JP | 2005-209358 | A | 8/2005 |
| WO | WO 02/087298 | A2 | 10/2002 |
| WO | WO 2007/022969 | A1 | 3/2007 |

OTHER PUBLICATIONS

Notice of the Reasons for Rejection, dated May 11, 2010 on the corresponding Japanese Application, three (3) pages.

* cited by examiner

*Primary Examiner* — Khiem Nguyen
(74) *Attorney, Agent, or Firm* — The Nath Law Group; Jerald L. Meyer; Jiaxiao Zhang

(57) ABSTRACT

A connector adequately detects a state of an electronic component such as a memory card which is fitted in the connector by way of insertion, even when scrapes of a housing of the electronic component are produced due to insertion and removal of the electronic component which is fitted. In this connector (100), detecting parts (160A and 160B), which detect that a memory card (20) is fitted completely in an accommodating part (102) or detect whether or not data can be written in the memory card (20), have fixed terminals (162) and movable terminals (161). In the movable terminal (161), a card contacting part (163*a*) placed in the accommodating part (102) is pressed by the memory card (20), so that a movable contact part (164*a*) contacts and conducts with the fixed terminal (162). An isolating wall part (190) is provided between the contacting part (163*a*) and the movable contact part (164*a*) to isolate a contact area between the movable contact part (164*a*) and the fixed terminal (162), from the contacting area between the contacting part (163*a*) and the memory card (20).

6 Claims, 7 Drawing Sheets

CONNECTOR

CROSS REFERENCE TO RELATED APPLICATIONS

The disclosure of Japanese Patent Application No. 2008-171544, filed on Jun. 30, 2008, including the specification, drawings and abstract, is incorporated herein by reference in its entirety.

BACKGROUND OF THE INVENTION

1. Field of the Invention

The present invention relates to a connector that is mounted on a substrate and that electrically connects with the substrate an electronic component such as a memory card that is inserted.

2. Description of the Related Art

Conventionally, memory cards with thin, flat housings made of resin are widely used as media for storing data in digital cameras, and small memory cards of various types and standards are known. Recently, memory cards are also used as media for storing data in mobile telephones, and very small memory cards are also available in the market.

Memory card connectors (also referred to as "connectors") are provided in electronic devices such as digital cameras and mobile telephones which use these memory cards as storing media, and the memory cards are fitted in electronic devices by inserting them in the memory card connectors (for example, see Japanese Patent Application Laid-Open No. 2003-022870 and Japanese Patent Application Laid-Open No. 2005-071666).

For example, as shown in Japanese Patent Application Laid-Open No. 2003-022870, in such a memory card connector, a detection switch is provided for detecting the state of electrical connection of a memory card by making contact portions of the memory card that is inserted in the connector body contact and separate from the connector body. As a detection switch, there is a card detection switch for detecting insertion of a card.

FIG. 1 shows a conventional configuration of a card detection switch for detecting insertion of a memory card connector in a conventional memory card connector.

Conventional card detection switch 1 shown in FIG. 1 is provided on one guiding sidewall 4 in connector body 3 to extend along the insertion direction of memory card 2 which is fitted.

Card detection switch 1 is constituted by fixed plate 5 which is placed along guiding sidewall 4 of connector body 3 and movable plate 6 which is placed in the width direction next to fixed plate 5 and placed to part from fixed plate 5.

Movable plate 6 has curved part 7 which faces fixed plate 5 in the width direction of connector body 3 and which projects from the guiding sidewall 4 side, into the route of insertion.

When memory card 2 is in a position where memory card 2 is fitted, curved part 7 of movable plate 6 is pushed by the side surface of memory card 2 and therefore the base end of curved part 7 abuts on fixed plate 5, thereby placing movable plate 6 and fixed plate 5 in an electrically conducting state (i.e. closed state).

In this way, with conventional memory card connectors, the original states of fixed plate 5 and movable plate 6 are in the electrically disconnected state (i.e. open state) on one guiding sidewall 4 side along the insertion direction. By contrast with this, when a memory card is inserted, movable plate 6 deflects sideward and contacts fixed plate 5, thereby placing fixed plate 5 and movable plate 6 in an electrically conducting state. Further, when memory card 2 is removed from connector body 3, curved part 7 of movable plate 6 is recovered, thereby placing movable plate 6 and fixed plate 5 in an electrically disconnected state. By so doing, insertion of a memory card is detected. Further, the ends of movable plate 6 and fixed plate 5 are connected with a card detection circuit on a printed substrate (not shown) on which connector body 3 is mounted.

However, with a conventional memory card, in the housing, fixed plate 5 contacting the base end of curved part 7 is placed in the width direction to face curved part 7 of movable plate 6 against which the card that is inserted slides. Therefore, there is a problem that scrapes of the card produced by contact between the side surface of the card made of resin and movable plate 6 move to the switch connecting portion between movable plate 6 and fixed plate 5, and hinder the contact between movable plate 6 and fixed plate 5.

SUMMARY OF THE INVENTION

It is therefore an object of the present invention to provide a connector that can adequately detect the state of an electronic component such as a memory card which is fitted by way of insertion even when scrapes of the housing of the electronic component are produced due to insertion and removal of the electronic component which is fitted.

To achieve the above object, the present invention employs a configuration which includes: a housing in which an electronic component is inserted from an insertion slot and in which the electronic component can be fitted in an accommodating part; and a switch which is opened and closed by the electronic component fitted in the accommodating part in the housing, and in which the switch has: a fixed terminal which is fixed to the housing; and a movable terminal which has: a contacting part which is placed in the accommodating part to flexibly move backward from the accommodating part and which is pressed by the electronic component inserted in the accommodating part and moves backward from the accommodating part; and a movable contact part which, accompanying the backward movement of the contacting part, moves in a same direction as the contacting part and contacts and conducts with the fixed terminal or parts from the fixed terminal; and an isolating wall part which isolates a contact area between the movable contact part and the fixed terminal from a contacting area between the contacting part and the electronic component, is provided between the contacting part and the movable contact part in the housing.

Further, to achieve the above object, the present invention employs a configuration which includes: a housing which has an accommodating part which accommodates a memory card which is inserted from an insertion slot; and a detecting part which is provided in the housing and which detects that the memory card is fitted completely in the accommodating part or detects whether or not data can be written in the memory card, and in which the detecting part has: a fixed terminal which is fixed in the housing; and a movable terminal which is placed to extend from an insertion slot side in the insertion direction and which is deflected and deformed and moves in a thickness direction of the memory card which is inserted; the movable terminal has: a contacting part which is placed in the accommodating part and which is pressed by the memory card which is inserted in the accommodating part, moves in the thickness direction and moves backward from the accommodating part; and a movable contact part which, accompanying the backward movement of the contacting part, moves in the thickness direction and contacts and conducts with the fixed terminal or parts from the fixed terminal; and an isolating wall part which isolates a contact area between the movable contact part and the fixed terminal from a contacting area between the contacting part and the memory card, is provided between the contacting part and the movable contact part in the housing.

DETAILED DESCRIPTION OF THE PREFERRED EMBODIMENT

An embodiment of the present invention will be explained in detail below with reference to the accompanying drawings. Although, with the present embodiment, a connector will be explained as a card connector to which a memory card is inserted as an electronic component, the present invention is not limited to this. As long as the connector is configured to electrically connect an electronic component which is inserted and the substrate on which the electronic component is mounted, this connector may be used for any electronic component.

Figure 1:
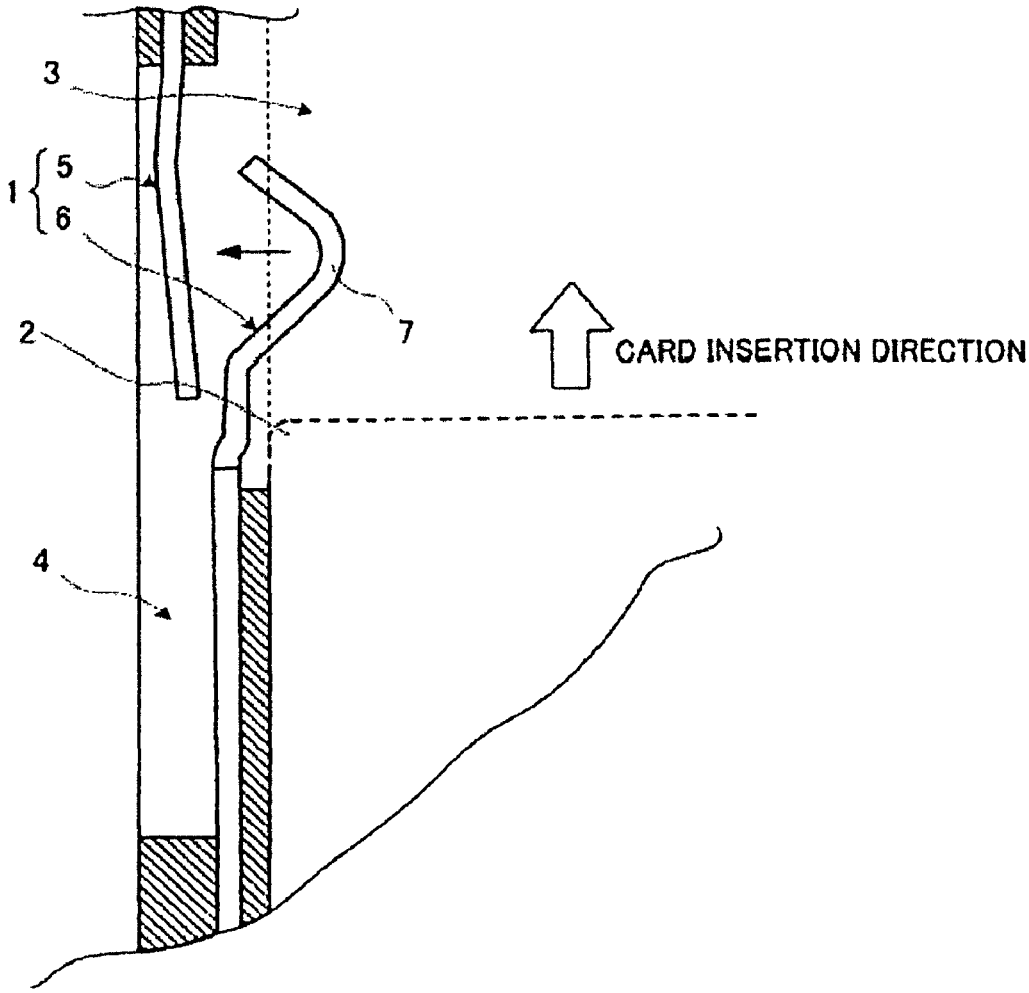
FIG. 1 shows a configuration of a card detection switch that detects insertion of a memory card in a conventional memory card connector.
Figure 2:
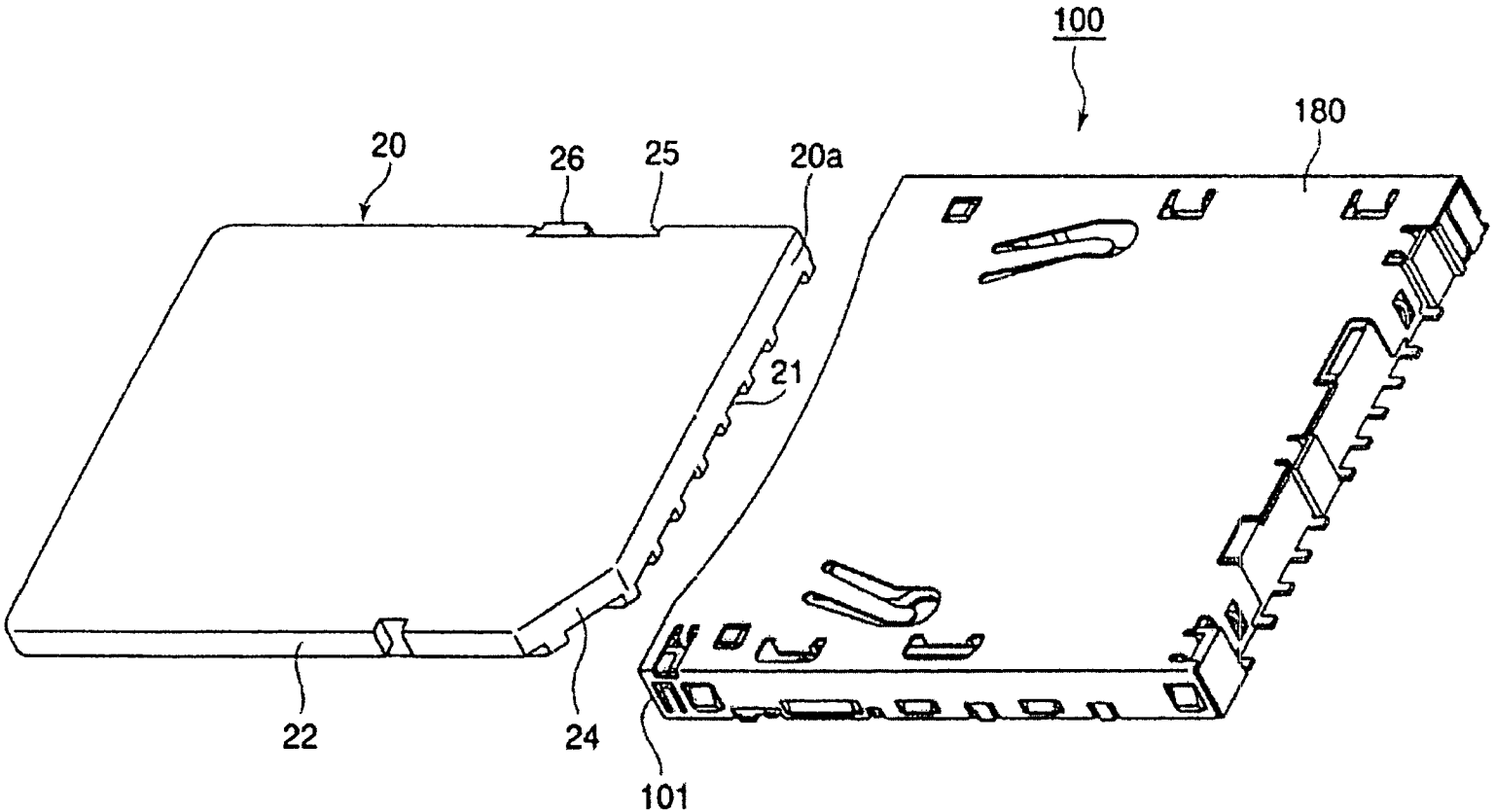
FIG. 2 is a perspective view showing a connector according to an embodiment of the present invention and a memory card fitted in the connector.
Figure 3:
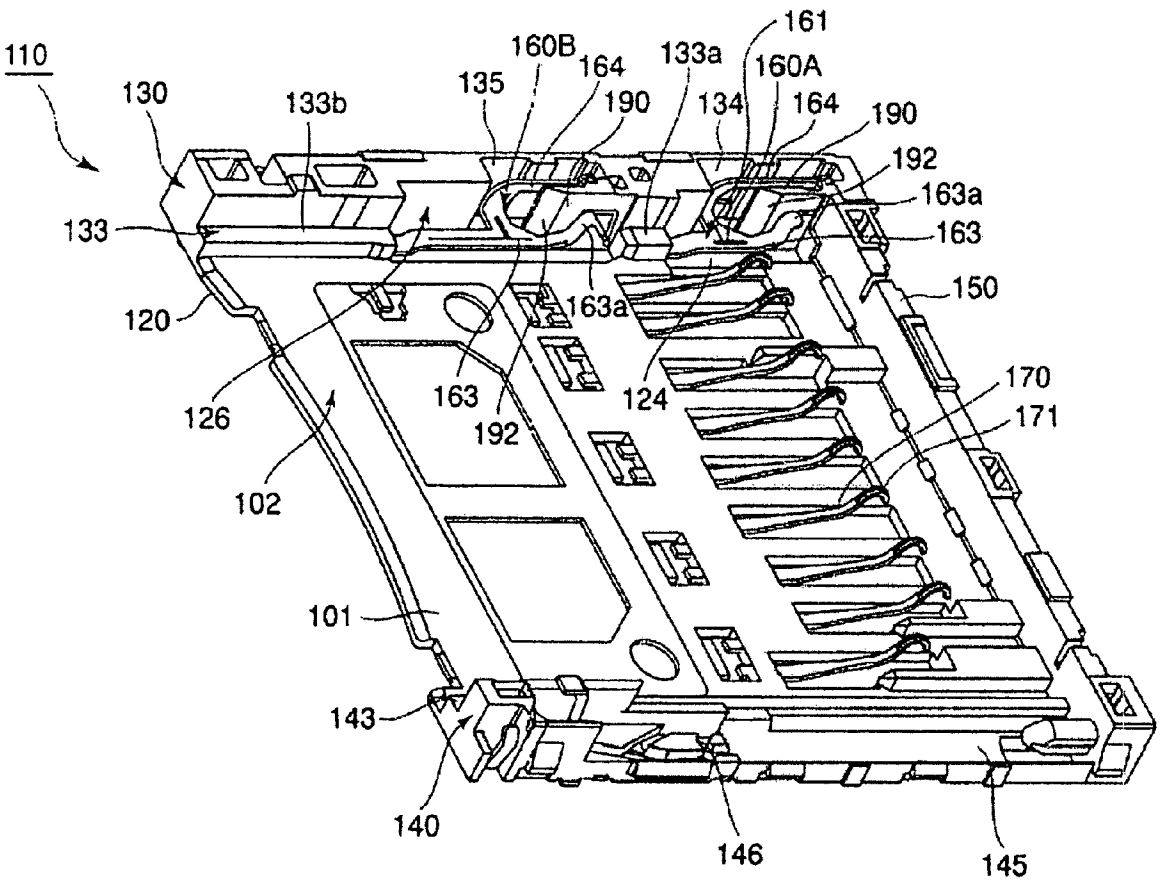
FIG. 3 is a perspective view of a housing having detection switches in the connector.
Figure 4:
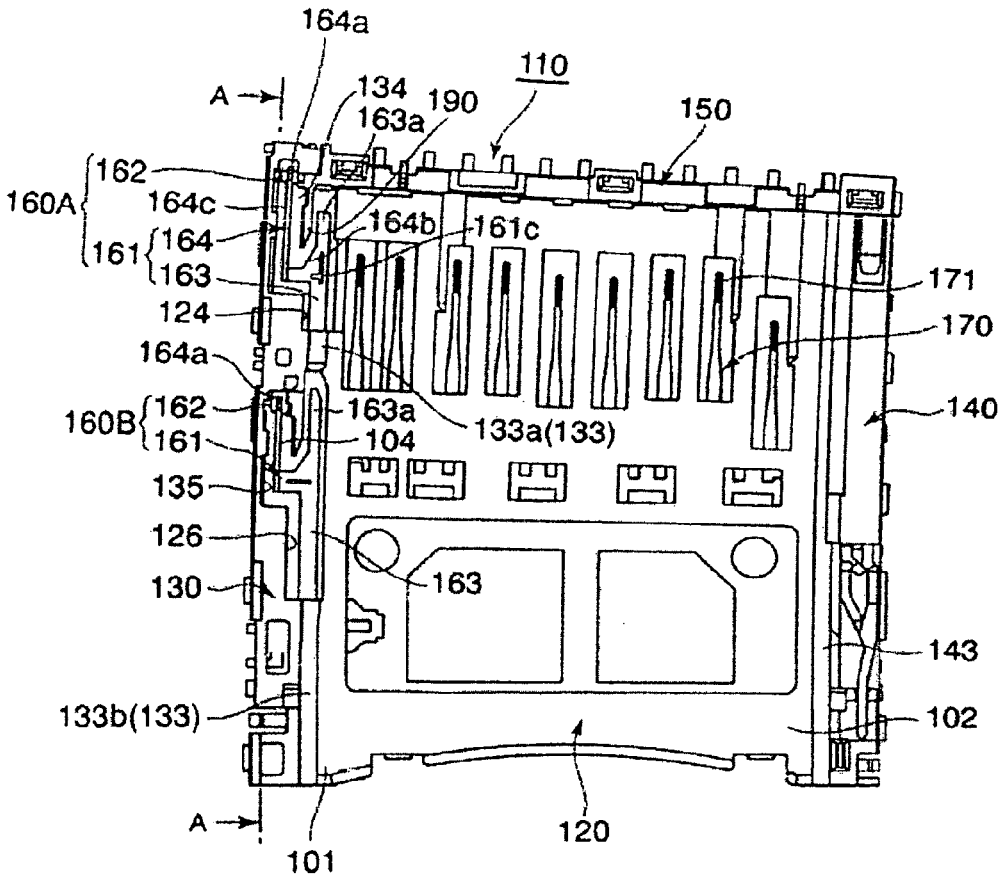
FIG. 4 is a plan view of the housing of the connector.
Figure 5:
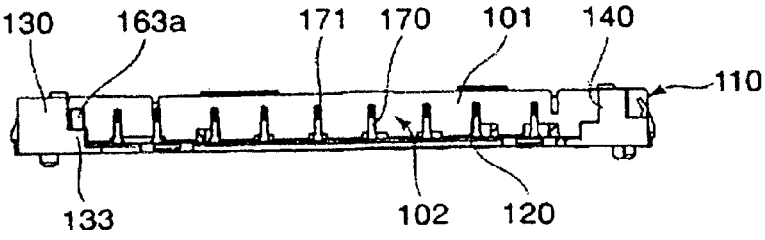
FIG. 5 is a front view of the housing of the connector.

FIG. 2 is a perspective view showing the connector according to an embodiment of the present invention and a memory card which is fitted in the connector, and FIG. 3 is a perspective view of a housing which has detection switches in the connector. FIG. 4 is a plan view of the housing of the connector, and FIG. 5 is a front view of the housing of the connector. Further, with the present embodiment, insertion slot 101 in which the memory card is inserted is defined as the front, and the rear, right and left are defined with reference to on the front.

Card connector 100 shown in FIG. 2 covers housing 110 (see FIG. 3) with shield cover 180 and has a rectangular flat shape that accommodates memory card 20 which is inserted from insertion slot 101 formed in one side surface. As shown in FIG. 3 and FIG. 4, card connector 100 has detection switches 160*a* and 160*b* inside.

As shown in FIG. 3, housing 110 is formed as a box which is made of an insulating material such as synthetic resin and the front surface and the upper surface of which are open and, has thin bottom plate part 120, both sidewall parts 130 and 140 and rear sidewall part 150. Accommodating part 102 which accommodates memory card 20 which is inserted is formed by covering this housing 110 from above with shield cover 180 (see FIG. 2) which has a cross-section of a U-shape which is open downward.

Further, this card connector 100 is formed to accommodate the shape of memory card 20 which is inserted. Generally, memory card 20 which is fitted in card connector 100 has a flash memory, in which data can be freely deleted and written and is not erased even if power is turned off. Here, memory card 20 will be explained.

Figure 6:
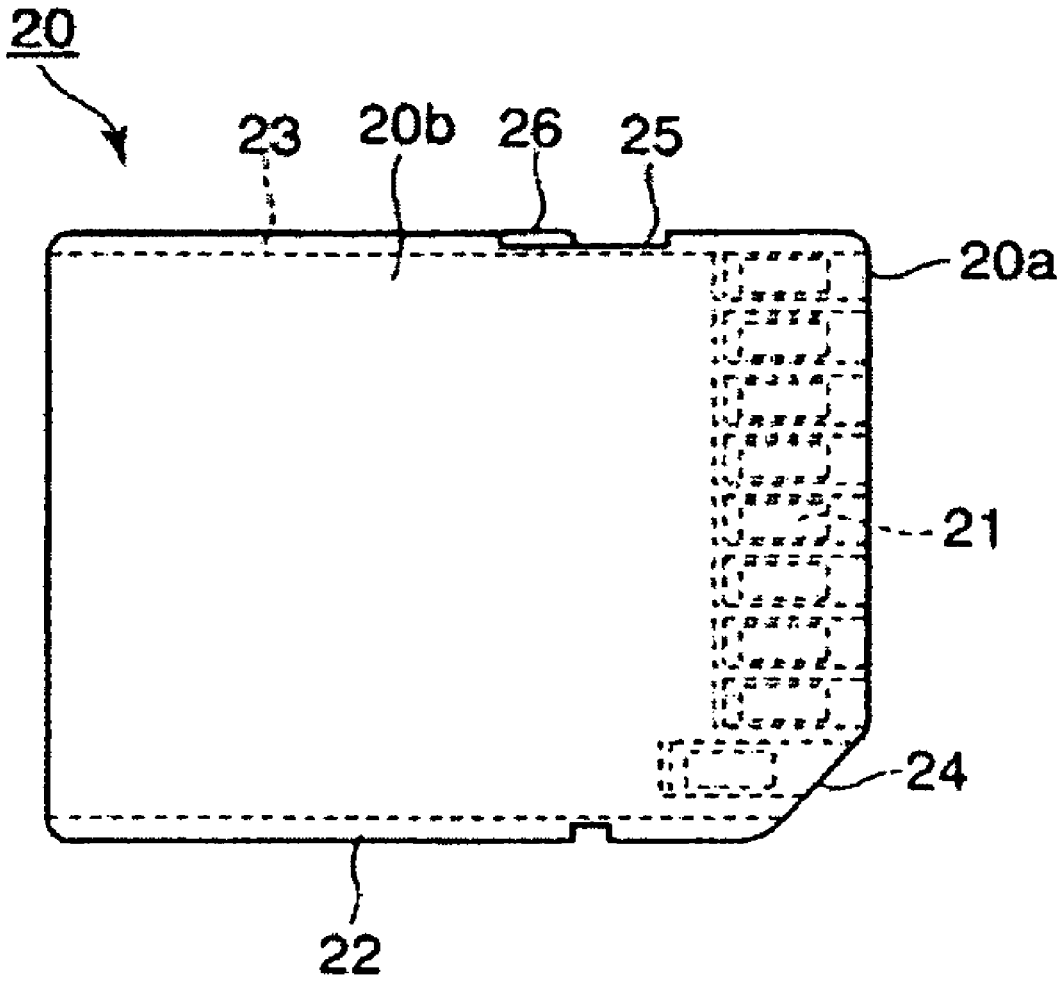
FIG. 6 is a plan view showing the memory card fitted in the connector.

FIG. 6 is a plan view showing a memory card which is fitted in the connector according to an embodiment of the present invention.

As shown in FIG. 6, memory card 20 is a thin flat plate which is made of resin and which accommodates an IC (not shown) inside, and a plurality of electrodes 21 (i.e. pads) which connect with a plurality of contact pins 170 of housing 110, are provided side by side in the width direction in the front end part in one surface (i.e. back surface) of memory card 20. Further, grooves which are open toward one surface (i.e. back surface) and sideward (i.e. width direction) are formed along the longitudinal direction of both side parts 22 and 23 of memory card 20.

In memory card 20, which has a rectangular shape when seen from a plan view, notch part 24 is formed by cutting a corner part in other side part 22 (i.e. the right side part when the insertion direction of memory card 20 with respect to card connector 100 is the front side) of front side part 20*a*. This notch part 24 makes front side part 20*a* of memory card 20 narrower toward the front side than the base side part.

Further, concave part 25, which functions as a distinguishing part which indicates that writing of data in the card is prohibited, is formed in one side part 23 (i.e. the left side part when the insertion direction side is the front side) of memory card 20. Distinguishing chip 26 is placed adjacent to this concave part 25 and slides toward concave part 25 along the direction in which other side part 23 of memory card 20 extends. By making this distinguishing chip 26 slide, concave part 25 is shut and whether or not data can be written in card 20 is determined depending on the position of distinguishing chip 26 in concave part 25.

Although memory card 20 allows data to be read and written freely, memory card 20 that does not allow data to be copied may also be possible. This memory card 20 includes PC cards, Compact Flash (registered trademark) cards, smart media, SD cards (Secure Digital memory cards), memory sticks and the like.

As shown in FIG. 3 and FIG. 4, a plurality of contact pins 170 are provided side by side in the width direction on the rear side of bottom plate part 120 in housing 110 in which memory card 20 is fitted. These contact pins 170 are flexible and are provided to project upward from bottom plate part 120. Projecting end parts 171 of contact parts 170 are contact parts 171 which are placed in positions in accommodating part 102 to meet the pads (see FIG. 6) of memory card 20, and which flexibly move downward. These contact parts 171 are pressed by electrodes 21 (see FIG. 6) of memory card 20 which is accommodated in accommodating part 102, and then contact parts 171 each contact and electrically connect with corresponding electrode 21 in a pair.

Further, contact pins 170 attached to housing 110 are built into housing 110 by insertion molding together with other electrically conductive components attached to housing 110.

Both sidewall parts 130 and 140, which rise from the both sides of bottom plate part 120 in housing 110, guide memory card 20 which is inserted from card insertion slot 101 in connector 100, toward rear sidewall part 150.

To be more specific, guide rails 133 and 143 are provided in right sidewall part 130 and left sidewall part 140 and project toward accommodating part 102 from the lower side parts of the inner wall surfaces of right sidewall part 130 and left sidewall part 140. These guide rails 133 and 143 extend along the lower side parts of both sidewall parts 130 and 140 inside housing 110, and, on the upper surfaces of guide rails 133 and 143, adequately guide both side parts 23 and 22 of memory card 20 which is inserted from insertion slot 101, into accommodating part 102. In this way, when memory card 20 is accommodated in accommodating part 102, both side parts 22 and 23 of memory card 20 are placed on the upper surfaces of guide rails 133 and 143. Here, guide rails 133 and 143 slide along the groove parts formed in both side parts 22 and 23 of memory card 20 (see FIG. 6).

Notch parts 134 and 135 are formed in one of both sidewall parts 130 and 140 in housing 110, here, in right sidewall part 130, and are isolated from accommodating part 102 by isolating wall parts 190 (see FIG. 4).

As shown in FIG. 4, notch parts 134 and 135 are formed in sidewall part 130 along accommodating part 102 across isolating wall parts 190, and communicate with accommodating part 102 on the insertion slot 101 side. The communicating portions in notch parts 134 and 135 which communicate with accommodating part 102 communicate with opening parts 124 and 126 which are formed by cutting, toward the insertion slot 101 side, part of guide rail 133 and part of bottom plate part 120 including part adjacent to the communicating portions and by cutting, in the insertion direction, bottom plate part 120 along isolating wall parts 190. Notch parts 134 and 135 and opening parts 124 and 126 form areas to provide detection switches, in housing 110.

In these areas to place the detection switches, card detection switch 160A and card writing possibility/impossibility detection switch 160B (also referred to as "writable/unwritable detection switch") are placed along the direction in which right sidewall part 130 extends, that is, along the insertion direction.

Figure 7:
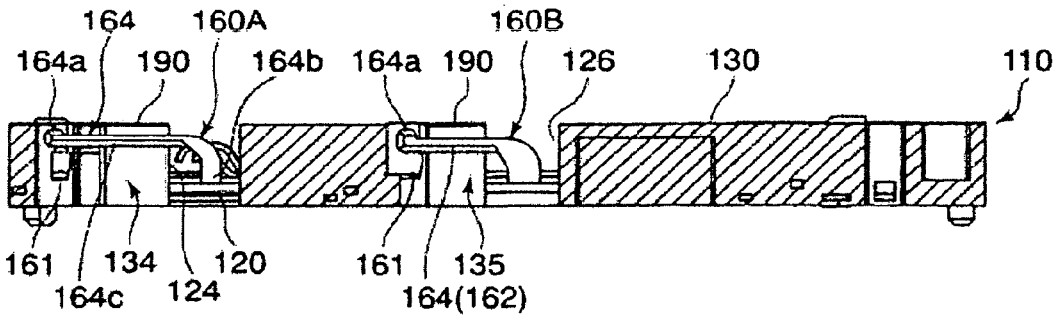
FIG. 7 is a side surface view of an A-A line seen the arrow view, showing notch parts of the housing.

FIG. 7 is a side surface view of an A-A line seen from the arrow view showing notch parts 134 and 135 of the housing.

In notch parts 134 and 135 shown in FIG. 3, FIG. 4 and FIG. 7, movable contact parts 164*a* of card detection switch 160A and card writable/unwritable detection switch 160B are placed along right sidewall part 130.

Detection switches 160A and 160B shown in FIG. 3, FIG. 4 and FIG. 7 electrically detect memory card 20 which is inserted in accommodating part 102. To be more specific, card detection switch 160A detects memory card 20 itself (see FIG. 6) which is inserted in accommodating part 102, and writable/unwritable detection switch 160B detects the position of distinguishing chip 26 (see FIG. 6) of memory card 20 which is fitted by way of insertion.

Card detection switch 160A and writable/unwritable detection switch 160B have virtually the same configuration and functions and are fitted in virtually the same way. Consequently, only the configuration of card detection switch 160A will be explained and explanation of writable/unwritable detection switch 160B will be omitted.

As shown in FIG. 4 and FIG. 7, card detection switch 160A has movable terminal 161 which is placed swingably in accommodating part 102 and which is pressed by memory card 20 which is inserted, and moves, and fixed terminal 162 which is fixed on the housing 110 side.

Movable terminal 161 and fixed terminal 162 are made by processing metal plates.

As shown in FIG. 3 and FIG. 4, movable terminal 161 has card contacting part 163*a* which contacts memory card 20 which is inserted and movable contact part 164*a* which contacts card contacting part 163*a* so as to contact and separate from fixed terminal 162.

Movable terminal 161 is made of a long, elastic, electrically conductive material (here, metal plate), is provided to overhang from part of guide rail 133 (first guide rail 133*a*) and is elastically deformed, thereby allowing its tip part to swing in the area to place the detection switch. Further, with writable/unwritable detection switch 160B, movable terminal 161 is provided to project from second guide rail 133*b* (see FIG. 3 and FIG. 4).

To be more specific, movable terminal 161 is provided to extend on extension of first guide rail 133*a* from the end surface in the depths of first guide rail 133*a* along the insertion direction, and has movable arm 163 which places its tip part in accommodating part 102 which communicates with the card insertion area (see FIG. 3 and FIG. 4).

As shown in FIG. 3, FIG. 4 and FIG. 5, the tip part of movable arm part 160 placed in accommodating part 102 serves as card contacting part 163*a* which contacts memory card 20 which is inserted in accommodating part 102. Card contacting part 163*a* is pressed by memory card 20 which is inserted, in the insertion direction, and moves in the direction to part from accommodating part 102.

In this way, movable arm part 163 extends from the insertion slot 101 side along the insertion direction, swings centering around the base end part side and is provided so as to flexibly move in a direction in which the tip part of card contacting part 163*a* located in accommodating part 102 in the direction parts from the interior of accommodating part 102.

Further, movable arm part 163 is coupled to contact arm part 164 which forms movable contact part 164*a* at its tip part.

Contact arm part 164 has contact arm part body 164*c* which extends along movable arm part 163 in the direction through coupling chip part 164*b* which extends in a direction to intersect the direction in which movable arm part 163 extends, that is, through coupling chip part 164*b* which extends toward right sidewall part 130. Movable contact part 164*a* is formed in the tip part of this contact arm part body 164*c*.

Coupling chip part 164*b* is placed in a communicating path through which opening part 124 and notch part 134 communicate. Further, both sides of this communicating path in the insertion direction are defined by right sidewall part 130 and isolating wall part 190 which partitions between notch part 134 and accommodating part 102.

As shown in FIG. 7, contact arm part body 164*c* extends from the tip part of coupling chip part 164*b* in the insertion direction of memory card 20, that is, toward the rear side of housing 110, and is placed parallel to movable arm part 163.

Contact arm part 164 (to be more specific, contact arm part body 164*c*) is formed longer than movable arm part 163 from a plan view, and movable contact part 164*a* in the tip of contact arm part 164 is located closer to the rear side than card contacting part 163*a* in the tip of movable arm part 163 (see FIG. 4).

With movable terminal 161 of the present embodiment, when seen from a plan view, contact arm part 164 has an equal length to the length from the base end part of movable arm part 163 to card contacting part 163*a*, thereby forming movable contact part 164*a* in the position closer to the rear side than card contacting part 163*a*.

By this means, when movable arm part 163 swings in a certain range centering around the base end part, the displacement of movable contact part 164*a* in the tip part of contact arm part 164 is greater than the displacement of card contacting part 163*a* in the tip part of movable arm part 163. By this means, the displacement of movable contact part 164*a* is made greater by the displacement of card contacting part 163*a*, so that it is possible to make movable contact part 164*a* part from fixed terminal 162 in a reliable manner.

This movable terminal 161 forms parts 163, 164 and 164*a* by processing a metal plate. The base end part of contact arm part 164 is formed by curving and raising the tip part of flat coupling chip part 164*b* projecting in the horizontal direction from movable arm part 163 of a belt shape to form contact arm part 164 which makes a bar member extend from the base end part of contact arm part 164 beyond movable arm part 163 along the longitudinal direction of movable arm part 163. The bar member serves as the body of contact arm part 164 and its tip part serves as movable contact part 164*a*.

Further, the jointing portion between movable arm part 163 and coupling chip part 164*b* is reinforced by limb 161*c*.

As shown in FIG. 3, card contacting part 163*a* is placed along first guide rail 133*a*, and has an inclining surface which is formed by curving its tip part toward accommodating part 102 and which inclines upward along the insertion direction. In this inclining surface, card contacting part 163*a* contacts memory card 20 which is inserted in accommodating part 102.

As shown in FIG. 3, FIG. 4 and FIG. 7, contact arm part 164 is placed in notch part 134 in right sidewall part 130 formed along accommodating part 102. In notch part 134, fixed terminal 162 is placed on the path that is drawn by movable contact part 164*a* in the tip part of contact arm part 164 when movable arm part 163 swings.

Figure 8:
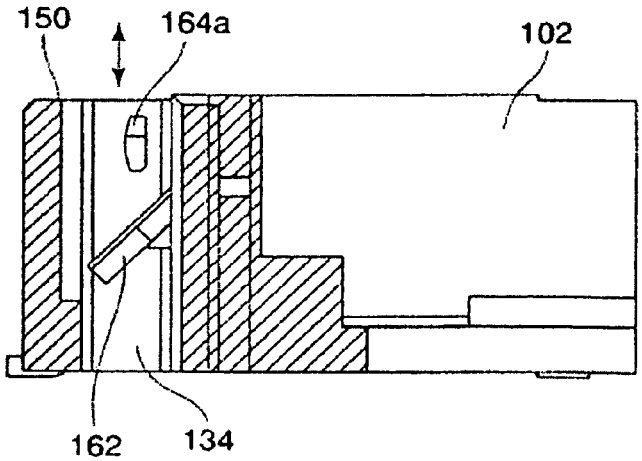
FIG. 8 shows the relationship between the positions of a fixed terminal and a contact part of a movable terminal, providing a cross-sectional view showing main parts of the fixed terminal and the contact part of the movable terminal seen from the insertion direction.

FIG. 8 shows the relationship between positions of a fixed terminal and a contact part of a movable terminal, providing a cross-sectional view showing main parts of the fixed terminal and the contact part of the movable terminal seen from the insertion direction.

As shown in FIG. 8, fixed terminal 162 has a drawn shape, is projected downward from the side of notch part 134 (to be more specific, rear sidewall part 150) and is placed to intersect the path of movable contact part 164*a*, in an area of notch part 134 formed by cutting a corner part between rear sidewall part 150 and right sidewall part 130. In the normal state, fixed terminal 162 is placed below movable contact part 164*a* in notch part 134, and, consequently, card detection switch 160A is a normal open switch which is turned off (i.e. electrically disconnection) when a card is not fitted.

In this way, in housing 110, a switch connecting portion (corresponding to a contact area) between movable contact part 164*a* of movable terminal 161 and fixed terminal 162 and a card contacting portion (corresponding to a contacting area) between card contacting part 163*a* of movable terminal 161 and memory card 20 which is inserted, are partitioned by isolating wall part 190, which is placed on a line connecting the switch connection portion and the card contacting portion. In other words, isolating wall part 190 is provided to intersect the line connecting the portion of movable contact part 164*a* which contacts a contact target (i.e. memory card 20) and the contact portion between movable contact part 164*a* and fixed terminal 162.

Isolating wall part 190 is part of right sidewall part 130 and its end part which, on the insertion direction, defines the communicating path side has inclining surface 192 which inclines toward the insertion slot in the width direction to part from accommodating part 102.

That is, isolating wall part 190 defines accommodating part 102 which is adjacent to isolating wall part 190 in the width direction of housing 110, such that accommodating part 102 becomes narrower toward the rear side of housing 110, that is, in the insertion direction. This inclining surface 192 makes it possible to adequately guide memory card 20 which is inserted, into accommodating part 102. Further, isolating wall part 190 is formed integrally with housing 110, and is reinforced by an electrically conductive metal material (here, metal plate) provided in housing 110 by insertion molding. To be more specific, isolating wall part 190 is formed with a metal chip which curves the metal plate embedded at the same height as the surface of bottom plate part 120 to rise to extend in the insertion direction and a resin material covering the metal piece. In this way, isolating wall part 190 is reinforced by the inner metal chip.

Further, in other sidewall part 140 (i.e. left sidewall part 140) of both sidewall parts 130 and 140 in housing 110, an ejecting mechanism is provided that includes: a slider which, when a card is inserted or removed, moves back and forth on the bottom surface of the housing along the insertion and removal direction of the memory card; and a coil spring which urges the slider toward the insertion slot of the memory card. Further, the ejecting mechanism is a known technique to hold a memory card in two positions. Here, one is referred to as an "insertion completion position" where the memory card is inserted completely in connector 100 and the other one is referred to as a "half-lock position" for loosely holding the memory card in an insertion position before the insertion completion position, and therefore explanations thereof will be omitted. In FIG. 3, spring accommodating part 145 which accommodates the coil spring and heart-cum part 146 which locks the slider in the insertion completion position, are provided in left sidewall part 140.

With connector 100 configured in this way, when memory card 20 is inserted from insertion slot 101, memory card 20 is guided by guide rails 133 and 143 of housing 110 and moves through accommodating part 102 toward rear sidewall part 150.

Memory card 20 which moves toward the rear side of housing 110 in accommodating part 102 abuts on card contacting part 163*a* projecting into accommodating part 102 and presses against card contacting part 163*a*. In this way, movable arm part 163 which forms card contacting part 163*a* at its tip is elastically deformed and is displaced downward with card contacting part 163*a*, and, accompanying this displacement, movable arm part 163 is placed in opening part 124 and contact arm part 164 which has movable contact part 164*a* swings and is displaced downward.

As a result of displacement of contact arm part 164, movable contact part 164*a* abuts on fixed terminal 162 below, and is kept in a state where movable contact part 164*a* presses against fixed terminal 162 while sliding against the inclining surface of fixed terminal 162. By this means, in a state where memory card 20 is accommodated in accommodating part 102 and is fitted completely in connector 100, memory card 20 is held in connector 100 in a state where electrodes 21 and contact pins 170 are electrically connected. At this time, movable terminal 161 and fixed terminal 162 contact, that is, electrically conduct with each other, in card detection switch 160A, and card detection switch 160A detects a state where the card is inserted completely, that is, a state where the card is fitted. In this way, memory card 20 which is inserted presses against and pushes back card contacting part 163*a* from accommodating part 102, and, accompanying this backward movement of this card contacting part 163*a*, movable contact part 164*a* moves in the same direction as card contacting part 163*a* and contacts and conducts with fixed terminal 162.

Further, writing possibility/impossibility detection switch 160B operates like card detection switch 160A. That is, card contacting part 163*a* of movable terminal 161 projecting in accommodating part 102 is pressed by memory card 20 (i.e.

notch part of one side part 23 which defines the groove part) which is inserted, thereby contacting movable contact part 164*a* and fixed terminal 162.

When memory card 20 is fitted completely, if concave part 25 is shut by distinguishing chip 26 in memory card 20, card contacting part 163*a* abuts on distinguishing chip 26 in concave part 25 from below and movable terminal 161 and fixed terminal 162 are kept in the contacted state. By this means, the connector detects that writing is possible.

By contrast with this, when distinguishing chip 26 is not placed in concave part 25 in memory card 20, if memory card 20 moves to the depths of accommodating part 102 and is inserted completely, card contacting part 163*a* is placed in notch concave part 25. That is, contacting part 163*a* projects and comes back to the original state in concave part 25 and, consequently, movable arm part 163 comes back to the original state and contact arm part 164 also returns to the original state (i.e. electrically disconnected state). By this means, contact arm part 164*a* moves to part from fixed terminal 162, thereby releasing the contacted state (i.e. electrically conducting state). Consequently, writing possibility/impossibility detection switch 160B enters the open state and detects that writing is not possible.

In these card detection switch 160A and writing possibility/impossibility detection switch 160B, insertion of memory card 20 makes movable terminals 161 move and contact and separate from fixed terminals 162.

When card detection switch 160A and writing possibility/impossibility detection switch 160B operate in connector 100, respective card contacting parts 163*a* repeat sliding against one side part 23 of memory card 20 which is inserted. In this way, the portion of one side part 23 of memory card 20 which contacts and slides against card contacting part 163*a* is scraped and produces scrapes.

In card detection switch 160A and writing possibility/impossibility detection switch 160B of connector 100 according to the present embodiment, the card contacting portion between card contacting part 163*a* and memory card 20 and a switch contact portion (i.e. contact area) between movable contact part 164*a* and fixed terminal 162 are placed close to one sidewall part of housing 110 (here, right sidewall part 130).

Further, these card contacting portion and switch contact portion are partitioned by isolating wall part 190 which is placed on the line to connect the card contacting portion and the switch contact portion. That is, the switch contact portion is isolated by isolating wall part 190 from accommodating part 102 in which card contacting part 163*a* is located.

In this way, with the present embodiment, housing 110 which has accommodating part 102 which accommodates memory card 20 which is inserted from insertion slot 101, card detection switch 160A (i.e. detecting part) which is provided in housing 110 and which completely fits memory card 20 in accommodating part 102, and writable/unwritable detection switch 160B (i.e. detecting part) which has basically the same configuration as card detection switch 160A and which detects whether or not data can be written in memory card 20, are provided. Further, each one of detection switches 160A and 160B has fixed terminal 162 which is fixed in housing 110 and movable terminal 161 which is placed to extend from the insertion slot 101 side in the insertion direction and which moves due to deflecting deformation. Movable terminal 161 has: card contacting part 163*a* which is placed in accommodating part 102 to flexibly move backward from accommodating part 102 and which is pressed by memory card 20 which is inserted in accommodating part 102 and moves backward from accommodating part 102; and movable contact part 164*a* which, accompanying this backward movement of card contacting part 163*a*, moves in the same direction as card contacting part 163*a* and contacts and conducts with fixed terminal 162. Further, isolating wall part 190 which isolates a contact area between movable contact part 164*a* and fixed terminal 162 from a contacting area between card contacting part 163*a* and memory card 20, is provided between card contacting part 163*a* and movable contact part 164*a* in housing 110.

Here, fixed terminals 162 are placed in housing 110 in a position close to accommodating part 102 in a direction to intersect the insertion direction. Further, movable terminals 161 are made by processing a long metal and extend in the insertion direction from the insertion slot side. Card contacting parts 163*a* are tip parts of movable arm parts 163 which project in accommodating part 102, and flexibly move backward from accommodating part 102 when movable arm parts 163 move. Contact arm parts 164 are formed to branch out from movable arm parts 163 toward fixed terminals 162 and conduct with fixed terminals 162 through movable contact parts 164*a* accompanying the movement of movable arm parts 163. Further, isolating wall parts 190 are provided between the branching portions between movable arm parts 163 and contact arm parts 164, card contacting parts 163*a* and movable contact parts 164*a*.

Consequently, isolating wall parts 190 prevent scrapes that are produced when memory card 20 is inserted and removed, thereby contacting and sliding against card contacting parts 163*a*, from moving to switch contact portions between movable contact parts 164*a* and fixed terminals 162. By this means, scrapes do not enter switch contact portions between movable contact parts 164*a* and fixed terminals 162 and contact failure does not occur, so that it is possible to detect that memory card 20 is inserted and detect whether or not data can be written in memory card 20.

Further, in connector 100, isolating wall parts 190 isolate, from accommodating part 102, switch contact portions between movable terminals 161 and fixed terminals 162 in card detection switch 160A and writing possibility/impossibility detection switch 160B. Therefore, even when dust enters accommodating part 102, contact failure in switch contact portions hardly occurs and movable terminals 161 and fixed terminals 162 can be isolated adequately.

According to the present embodiment, it is possible to miniaturize the connector and save a footprint in response to miniaturization of memory card 20 which is inserted and electrically connected, and adequately place each switch 160A and 160B in the contacted state even when scrapes are produced from the housing of memory card 20 due to insertion and removal of memory card 20. Consequently, it is possible to adequately detect that memory card 20 is inserted and detect whether or not data can be written in memory card 20 which is fitted by way of insertion.

Figure 9:
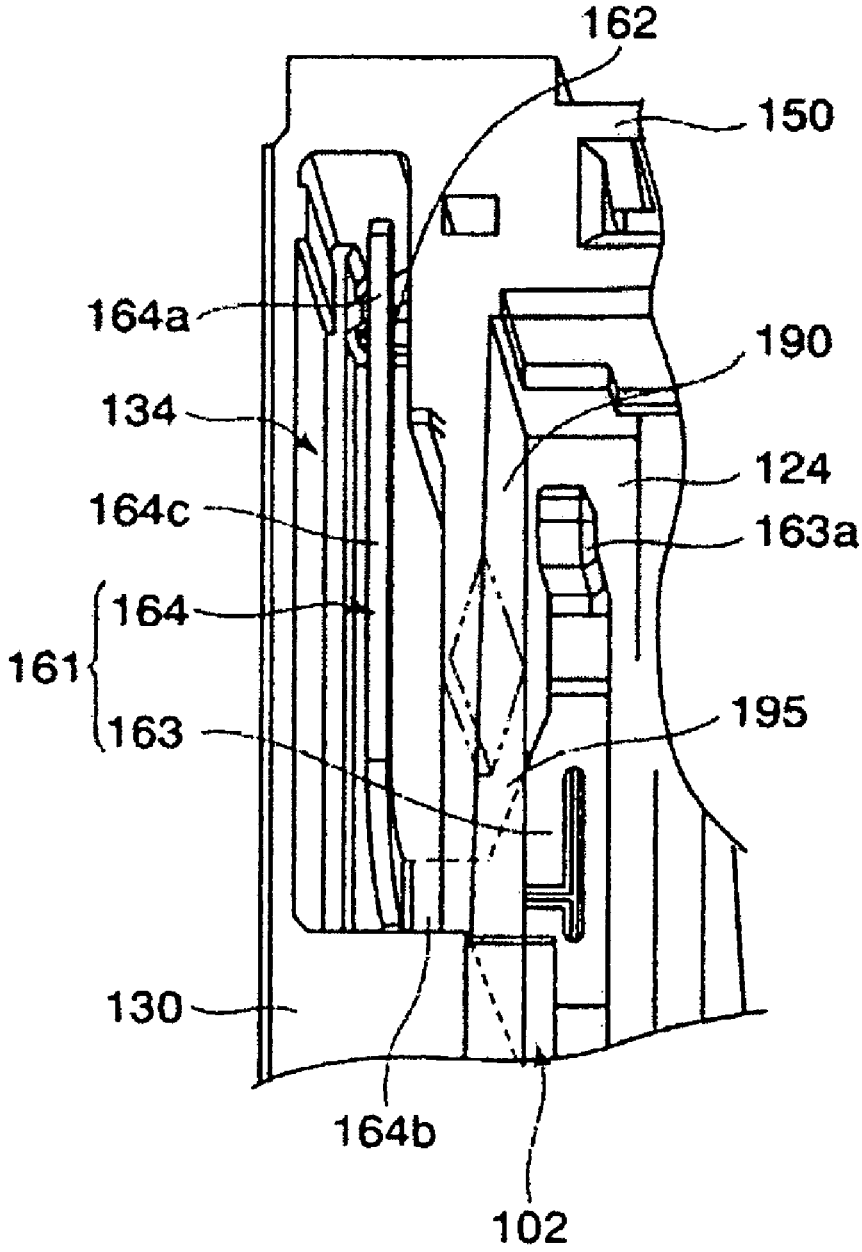
FIG. 9 is a perspective view showing main parts of a modified example of the connector according to the present embodiment.

Further, the communicating paths, through which notch parts 134 and 135 communicate with accommodating part 102 and in which coupling chip parts 164*b* of movable terminals 161 are swingably placed, may be shut by wall parts 195 as shown in FIG. 9 as long as movable terminals 161 have the above functions.

FIG. 9 shows a modified example where communicating paths, in which coupling chip parts 164*b* of the jointing portions between movable arm parts 163 and contact arm parts 164 of movable terminals 161 are placed, are shut by wall parts 195 in connector 100 according to the present embodiment.

In this way, wall parts 195 shut the communicating paths which communicate with the areas in which movable arm parts 163 are placed and which communicate with the areas in which contact arm parts 164 are placed, and the inner wall surface of one sidewall part 130 (i.e. right sidewall part) is made to extend in the longitudinal direction, so that it is possible to further prevent scrapes produced in card contacting portions which contact memory card 20, from entering the switch contact portions.

Further, movable contact parts 164*a* contact fixed terminals 162 while sliding against the inclining surfaces of fixed terminals 162. Accordingly, even when there are foreign materials such as dust between movable contact parts 164*a* and fixed terminals 162, movable contact parts 164*a* and fixed terminals 162 slide against each other and, consequently, can remove the foreign materials in contacting portions between movable contact parts 164*a* and fixed terminals 162.

Further, although card detection switch 160A and writing possibility/impossibility detection switch 160B are normal open switches in connector 100 according to the present embodiment, the present invention is not limited to this and may employ normal close switches. In this case, insertion of card is detected when fixed terminals 162 is parts from movable terminals 161 upon insertion of the card.

Further, although memory card 20 with electrodes 21 is fitted in connector 100 by way of insertion according to the present embodiment and electrodes 21 are electrically connected with contact pins 170, any electronic component may be fitted in connector 100 as long as it can be inserted and electrically connected with connector 100.

Further, the above present invention can be variously modified without departing from the spirit of the present invention, and it naturally follows that the present invention covers such modifications.

The connector according to the present invention provides an advantage of adequately detecting a state of an electronic component such as a memory card which is fitted by way of insertion, even when scrapes of a housing are produced due to insertion and removal of the electronic component which is fitted by way of insertion, and is useful for a memory card connector in particular.

What is claimed is:

1. A connector comprising:

a housing in which an electronic component is inserted from an insertion slot and in which the electronic component can be fitted in an accommodating part; and a switch which is opened and closed by the electronic component fitted in the accommodating part in the housing, wherein:

the switch comprises:

a fixed terminal which is fixed to the housing; and a movable terminal which comprises:

a contacting part which is placed in the accommodating part to flexibly move backward from the accommodating part and which is pressed by the electronic component inserted in the accommodating part and moves backward from the accommodating part; and a movable contact part which, accompanying the backward movement of the contacting part, moves in a same direction as the contacting part and contacts and conducts with the fixed terminal or parts from the fixed terminal; and an isolating wall part which isolates a contact area between the movable contact part and the fixed terminal, from a contacting area between the contacting part and the electronic component, is provided between the contacting part and the movable contact part in the housing.

2. A connector comprising:

a housing which comprises an accommodating part which accommodates a memory card which is inserted from an insertion slot; and a detecting part which is provided in the housing and which detects that the memory card is fitted completely in the accommodating part or detects whether or not data can be written in the memory card, wherein:

the detecting part comprises:

a fixed terminal which is fixed in the housing; and a movable terminal which is placed to extend from an insertion slot side in the insertion direction and which is deflected and deformed and moves in a thickness direction of the memory card which is inserted;

the movable terminal comprises:

a contacting part which is placed in the accommodating part and which is pressed by the memory card which is inserted in the accommodating part, moves in the thickness direction and moves backward from the accommodating part; and a movable contact part which, accompanying the backward movement of the contacting part, moves in the thickness direction and contacts and conducts with the fixed terminal or parts from the fixed terminal; and an isolating wall part which isolates a contact area between the movable contact part and the fixed terminal, from a contacting area between the contacting part and the memory card, is provided between the contacting part and the movable contact part in the housing.

3. The connector according to claim 1, wherein the isolating wall part is provided on a virtually straight line that connects a portion of the contacting part which contacts a contact target, with the contact portion between the movable contact part and the fixed terminal, and intersects the straight line.

4. The connector according to claim 2, wherein the isolating wall part is provided on a virtually straight line that connects a portion of the contacting part which contacts a contact target, with the contact portion between the movable contact part and the fixed terminal, and intersects the straight line.

5. The connector according to claim 1, wherein:

the fixed terminal is placed in a position in the housing adjacent to the accommodating part in a direction to intersect the insertion direction;

the movable terminal comprises:

a movable arm part which is made of a long metal plate, which extends from the insertion slot side in the insertion direction, which makes a tip part project in the accommodating part to form the contacting part and which allows the contacting part to flexibly move backward from the accommodating part; and a contact arm part which is formed to branch out from the movable arm part toward the fixed terminal and which comprises the movable contact part which, accompanying the movement of the movable arm part, contacts and conducts with the fixed terminal or parts from the fixed terminal; and the isolating wall part is provided between the contacting part, the movable contact part, and a branching portion between the movable arm part and the contact arm part.

6. The connector according to claim 5, wherein an end part of the isolating wall part on the insertion slot side comprises an inclining surface which inclines in a direction to part from the accommodating part.

* * * * *